US010125621B2

(12) United States Patent
Barry et al.

(10) Patent No.: US 10,125,621 B2
(45) Date of Patent: Nov. 13, 2018

(54) BLADED ROTOR ARRANGEMENT AND A LOCK PLATE FOR A BLADED ROTOR ARRANGEMENT

(71) Applicant: ROLLS-ROYCE PLC, London (GB)

(72) Inventors: Matthew J Barry, Derby (GB); Christopher Murphy, Derby (GB); Philip Scope, Derby (GB)

(73) Assignee: ROLLS-ROYCE plc, London (GB)

( * ) Notice: Subject to any disclaimer, the term of this patent is extended or adjusted under 35 U.S.C. 154(b) by 358 days.

(21) Appl. No.: 14/859,505

(22) Filed: Sep. 21, 2015

(65) Prior Publication Data

US 2016/0090850 A1 Mar. 31, 2016

(30) Foreign Application Priority Data

Sep. 26, 2014 (GB) ..... 1417039.3

(51) Int. Cl.
*F01D 5/32* (2006.01)
*F01D 5/12* (2006.01)
(Continued)

(52) U.S. Cl.
CPC ..... *F01D 5/326* (2013.01); *F01D 5/02* (2013.01); *F01D 5/081* (2013.01); *F01D 5/12* (2013.01);
(Continued)

(58) Field of Classification Search
CPC ..... F01D 5/326; F01D 5/3015; F01D 5/30; F01D 5/3007; F01D 5/081; F01D 5/082; F01D 5/12; F01D 11/006
See application file for complete search history.

(56) References Cited

U.S. PATENT DOCUMENTS 3,043,562 A * 7/1962 Fusner ..... F01D 5/3015 416/193 A
4,582,467 A 4/1986 Kisling
(Continued)

FOREIGN PATENT DOCUMENTS

EP 0 921 272 A2 6/1999
EP 1 916 389 A1 4/2008
(Continued)

OTHER PUBLICATIONS

Feb. 25, 2016 Search Report issued in European Patent Application No. 15186032.

*Primary Examiner* — Logan Kraft
*Assistant Examiner* — Elton Wong
(74) *Attorney, Agent, or Firm* — Oliff PLC

(57) ABSTRACT

A bladed rotor arrangement comprises a rotor, a plurality of rotor blades and a plurality of lock plates. The rotor blades are mounted in circumferentially spaced axially extending slots in the periphery of the rotor. A plurality of lock plates are arranged at a first axial end of the rotor and a plurality of lock plates are arranged at a second axial end of the rotor. The radially outer ends of the lock plates engage corresponding grooves defined by radially inwardly extending flanges on the platforms of the rotor blades. The radially inner ends of the lock plates also engage circumferentially extending grooves. The radially inner end of each lock plate has three crushable, deformable, circumferentially spaced feet to reduce the risk of the lock plates chocking against the rotor, or seal plates and additional radial loads being reacted by the rotor blades into the rotor.

23 Claims, 7 Drawing Sheets

(51) Int. Cl.

| | |
|---|---|
| ***F01D 5/30*** | (2006.01) |
| ***F01D 11/00*** | (2006.01) |
| ***F01D 5/02*** | (2006.01) |
| ***F01D 5/08*** | (2006.01) |

(52) U.S. Cl.

CPC ..... *F01D 5/3007* (2013.01); *F01D 5/3015* (2013.01); *F01D 11/006* (2013.01); *F05D 2220/32* (2013.01); *F05D 2240/24* (2013.01); *F05D 2240/55* (2013.01); *F05D 2260/30* (2013.01); *F05D 2260/311* (2013.01)

(56) References Cited

U.S. PATENT DOCUMENTS

| | | | | |
|---|---|---|---|---|
| 4,701,105 | A | 10/1987 | Cantor et al. | |
| 4,890,981 | A * | 1/1990 | Corsmeier | F01D 5/3015 416/220 R |
| 6,416,282 | B1 * | 7/2002 | Beeck | F01D 5/087 415/115 |
| 2005/0232751 | A1 | 10/2005 | Townes et al. | |
| 2008/0008593 | A1 * | 1/2008 | Zagar | F01D 5/3015 416/220 R |
| 2010/0047073 | A1 * | 2/2010 | Bluck | F01D 5/3015 416/220 R |
| 2011/0164983 | A1 | 7/2011 | Garcia-Crespo et al. | |
| 2011/0200448 | A1 | 8/2011 | Elliott et al. | |
| 2012/0082568 | A1 | 4/2012 | Tibbott et al. | |
| 2013/0272886 | A1 * | 10/2013 | Dimmick, III | F01D 5/3015 416/220 R |
| 2016/0265378 | A1 * | 9/2016 | Dungs | F01D 5/3015 |

FOREIGN PATENT DOCUMENTS

| | | | | |
|---|---|---|---|---|
| EP | 2182170 | A1 | 5/2010 | |
| EP | 2 436 882 | A2 | 4/2012 | |
| EP | 2436879 | A2 | 4/2012 | |
| GB | 1 222 926 | A | 2/1971 | |
| GB | 1 286 776 | A | 8/1972 | |
| GB | 2409240 | A | 6/2005 | |
| GB | 2 435 909 | A | 9/2007 | |
| GB | 2435909 | A * | 9/2007 | F01D 5/081 |

* cited by examiner

BLADED ROTOR ARRANGEMENT AND A LOCK PLATE FOR A BLADED ROTOR ARRANGEMENT

FIELD OF THE INVENTION

The present disclosure relates to a bladed rotor arrangement and in particular to a bladed rotor arrangement of a gas turbine engine or a turbomachine.

BACKGROUND OF THE INVENTION

Gas turbine engines comprise a plurality of bladed rotors, each of which comprises a rotor and a plurality of rotor blades mounted on the periphery of the rotor. Each rotor blades has an aerofoil, a platform, a shank and a root. The rotor comprises a plurality of circumferentially spaced axially extending slots. The root of each rotor blade is arranged to locate in a respective one of the axially extending slots in the periphery of the rotor. The roots of the rotor blades are generally fir tree shaped or dovetail shaped and the axially extending slots are correspondingly shaped to receive the roots of the rotor blades.

The bladed rotor arrangement also comprises a plurality of lock plates arranged at a first axial end of the rotor and a plurality of lock plates arranged at a second axial end of the rotor to prevent the rotor blades moving axially relative to the rotor. The lock plates also acts as seals to prevent fluid flowing through the axially extending slots in the rotor and axially between the shanks of the rotor blades and radially between the platforms of the rotor blades and the periphery of the rotor. The radially outer ends of lock plates at the first axial end of the rotor engage grooves defined by radially inwardly extending flanges on the platforms of the rotor blades and the radially outer ends of the lock plates at the second axial end of the rotor engage grooves defined by radially inwardly extending flanges on the platforms of the rotor blades. The radially inner ends of the lock plates engage circumferentially extending grooves in the rotor or circumferentially extending grooves defined by seal plates and the rotor.

However, the arrangement described has suffered from a problem that under certain circumstances, e.g. a combination of manufacturing tolerances of the components, operation of the gas turbine engine for a long period of time at high power conditions, operation of the gas turbine engine for a short period of time at idle conditions followed by shutting down the gas turbine engine, the lock plates may move from their desired position. In particular it has been found that under these circumstances the lock plates may move radially inwardly from their desired positions such that the radially outer ends of the lock plates move out of the groove defined by the platforms of the rotor blades and become wedged against the radially inwardly extending flanges on the platforms of the rotor blades and are at risk of becoming completely disengaged. If the gas turbine engine subsequently operates a slam acceleration manoeuvre the lock plates may chock against the rotor, or seal plates, and additional radial loads may be reacted by the rotor blades through the roots of the rotor blades into the rotor.

Therefore the present disclosure seeks to provide a novel bladed rotor arrangement which reduces or overcomes the above mentioned problem.

STATEMENTS OF INVENTION

Accordingly the present disclosure provides a bladed rotor arrangement comprising a rotor, a plurality of rotor blades and a plurality of lock plates, the rotor blades being mounted on the periphery of the rotor, each rotor blade comprising an aerofoil, a platform, a shank and a root, the rotor comprising a plurality of circumferentially spaced axially extending slots, the root of each rotor blade locating in a respective one of the axially extending slots in the periphery of the rotor, a plurality of lock plates being arranged at a first axial end of the rotor, the radially outer ends of the lock plates at the first axial end of the rotor engaging grooves defined by radially inwardly extending flanges on the platforms of the rotor blades, the radially inner ends of the lock plates at the first axial end of the rotor engaging a circumferentially extending groove, the circumferentially extending groove being defined by the rotor and at least one radially extending member spaced axially from the first end of the rotor, the radially outer end of the at least one radially extending member having the same radius throughout the full circumference of the at least one radially extending member, wherein the radially inner end of at least one lock plate at the first axial end of the rotor having a first foot and a second foot spaced circumferentially from the first foot, and the first and second feet of the at least one lock plate being crushable and/or deformable.

A plurality of lock plates may be arranged at a second axial end of the rotor, the radially outer ends of the lock plates at the second axial end of the rotor engaging grooves defined by radially inwardly extending flanges on the platforms of the rotor blades, the radially inner ends of the lock plates at the second axial end of the rotor engaging a circumferentially extending groove, the circumferentially extending groove being defined by the rotor and at least one radially extending member spaced axially from the second axial end of the rotor, the radially outer end of the at least one radially extending member having the same radius throughout the full circumference of the at least one radially extending member, wherein the radially inner end of at least one lock plate at the second axial end of the rotor having a first foot and a second foot spaced circumferentially from the first foot, and the first and second feet of the at least one lock plate being crushable and/or deformable.

The radially inner end of each lock plate at the first axial end of the rotor may have a first foot and a second foot spaced circumferentially from the first foot, and the first and second feet of each lock plate being crushable and/or deformable.

The radially inner end of each lock plate at the second axial end of the rotor may have a first foot and a second foot spaced circumferentially from the first foot, and the first and second feet of each lock plate being crushable and/or deformable.

The radially inner end of the at least one lock plate may have a first foot at a first end of the lock plate, a second foot at a second end of the lock plate, and the first and second feet of the at least one lock plate being crushable and/or deformable.

The radially inner end of the at least one lock plate may have a first foot at a first end of the lock plate, a second foot in a mid-region of the lock plate and a third foot at a second end of the lock plate, the first, second and third feet of the at least one lock plate being crushable and/or deformable.

The radially inner end of each lock plate at the first axial end of the rotor may have a first foot at a first end of the lock plate, a second foot at a second end of the lock plate and a third foot in a mid-region of the lock plate, the first, second and third feet of each lock plate being crushable and/or deformable and/or the radially inner end of each lock plate at the second axial end of the rotor may have a first foot at a first end of the lock plate, a second foot at a second end of the lock plate and a third foot in a mid-region of the lock plate, the first, second and third feet of each lock plate being crushable and/or deformable.

The first, second or third foot may be axially thinner than the remainder of the lock plate.

The first, second and third foot may be axially thinner than the remainder of the lock plate.

The radial height of the first, second or third foot may be between 1 and 1.6 times the axial thickness of the first, second or third foot. The radial height of the first, second and third foot may be between 0.6 mm to 0.8 mm inclusive. The axial thickness of the first, second or third foot may be 0.5 mm.

The radially inner end of the first, second and third foot may be arranged as a radius of the rotor.

The first, second and third foot may be smoothly curved from the radially inner end of the lock plate.

The radially inner ends of the lock plates may engage circumferentially extending grooves in the rotor.

The bladed rotor arrangement may comprise a plurality of seal plates, at least one seal plate being arranged at the first axial end of the rotor and at least one seal plates being arranged at the second axial end of the rotor, the radially inner ends of the lock plates at the first axial end of the rotor engaging a circumferentially extending groove at least partially defined by the at least one seal plate at the first axial end of the rotor, the radially inner ends of the lock plates at the second axial end of the rotor engaging a circumferentially extending groove at least partially defined by the at least one seal plate at the second axial end of the rotor.

The bladed rotor arrangement may comprise a plurality of seal plates arranged at the first axial end of the rotor and a plurality of plates arranged at the second axial end of the rotor.

The roots of the rotor blades may be generally fir tree shaped or dovetail shaped and the axially extending slots are correspondingly shaped to receive the roots of the rotor blades.

The radially outer end of each lock plate may have a lip and the radially inner end of each lock plate may have a lip.

Each lock plate may have a first face facing away from the rotor and a second face facing the rotor.

The first face of each lock plate may be generally flat between the lips at the radially inner and radially outer ends of the lock plate.

The second face of each lock plate may have at least one channel and at least one deflector, the at least one channel extending radially from the radially inner end of the lock plate towards the radially outer end of the lock plate, the at least one deflector being arranged at the radially outer end of the at least one channel, the at least one deflector extending axially from the second surface of the lock plate.

The second face of each lock plate may have a plurality of channels and a plurality of deflectors, each channel extending radially from the radially inner end of the lock plate towards the radially outer end of the lock plate, each deflector being arranged at the radially outer end of a corresponding one of the channels, each deflector extending axially from the second surface of the lock plate.

The second face of each lock plate may have at least one pocket. The second face of each lock plate may have a plurality of pockets.

The second face of each lock plate may have anti-rotation feature. The anti-rotation feature may be a projection extending axially from the second face of the lock plate and arranged to locate in a slot in the root of a rotor blade. The anti-rotation feature may be a pair of circumferentially spaced projections extending axially from the second face of the lock plate, the projections being arranged to locate against the shanks of circumferentially spaced apart rotor blades.

The at least one seal plate may have at least one anti-rotation feature, each anti-rotation feature extending axially from the at least one seal plate, each anti-rotation feature locating in a slot in an axial end of the root of a corresponding one of the rotor blades. Each anti-rotation feature may locate in a slot in the axial end of the radially inner end of the root of the corresponding one of the rotor blades.

The at least one seal plate at the first axial end of the rotor may have at least one anti-rotation feature, each anti-rotation feature locating in a slot in the first axial end of the root of a corresponding one of the rotor blades. Each anti-rotation feature may locate in a slot in the first axial end of the radially inner end of the root of the corresponding one of the rotor blades.

The at least one seal plate at the second axial end of the rotor may have at least one anti-rotation feature, each anti-rotation feature locating in a slot in the second axial end of the root of a corresponding one of the rotor blades. Each anti-rotation feature may locate in a slot in the second axial end of the radially inner end of the root of the corresponding one of the rotor blades.

The at least one seal plate may have a plurality of anti-rotation features.

The feet of each lock plate resting on the anti-rotation features of the at least one lock plate.

The middle foot of each lock plate resting on a corresponding one of the anti-rotation features, the first foot of each lock plate resting on a half of a corresponding one of the anti-rotation features and the third foot of each lock plate resting on a half of a corresponding one of the anti-rotation features.

The bladed rotor arrangement may comprise a turbine disc and a plurality of turbine rotor blades.

The present disclosure also provides an arcuate lock plate, the lock plate having a radially outer end and a radially inner end, the radially inner end the lock plate having a first foot and a second foot spaced circumferentially from the first foot, and the first and second feet of the arcuate lock plate being crushable and/or deformable.

The radially inner end of the lock plate may have a first foot at a first end of the lock plate, a second foot in a mid-region of the lock plate and a third foot at a second end of the lock plate, the first, second and third feet of the arcuate least one lock plate being crushable and/or deformable.

The first, second and/or third foot may be axially thinner than the remainder of the lock plate.

The radial height of the first, second or third foot may be between 1 and 1.6 times the axial thickness of the first, second or third foot.

The radially outer end of the lock plate may have a lip and the radially inner end of the lock plate has a lip.

The lock plate may have a first face and a second face.

The first face of the lock plate may be generally flat between the lips at the radially inner and radially outer ends of the lock plate.

The second face of the lock plate may have at least one channel and at least one deflector, the at least one channel extending radially from the radially inner end of the lock plate towards the radially outer end of the lock plate, the at least one deflector being arranged at the radially outer end of the at least one channel, the at least one deflector extending axially from the second surface of the lock plate.

The second face of the lock plate may have a plurality of channels and a plurality of deflectors, each channel extending radially from the radially inner end of the lock plate towards the radially outer end of the lock plate, each deflector being arranged at the radially outer end of a corresponding one of the channels, each deflector extending axially from the second surface of the lock plate.

The second face of the lock plate may have at least one pocket.

The second face of the lock plate may have a plurality of pockets.

The second face of the lock plate may have an anti-rotation feature.

BRIEF DESCRIPTION OF THE DRAWINGS

The present disclosure will be more fully described by way of example with reference to the accompanying drawings, in which.

DETAILED DESCRIPTION

Figure 1:
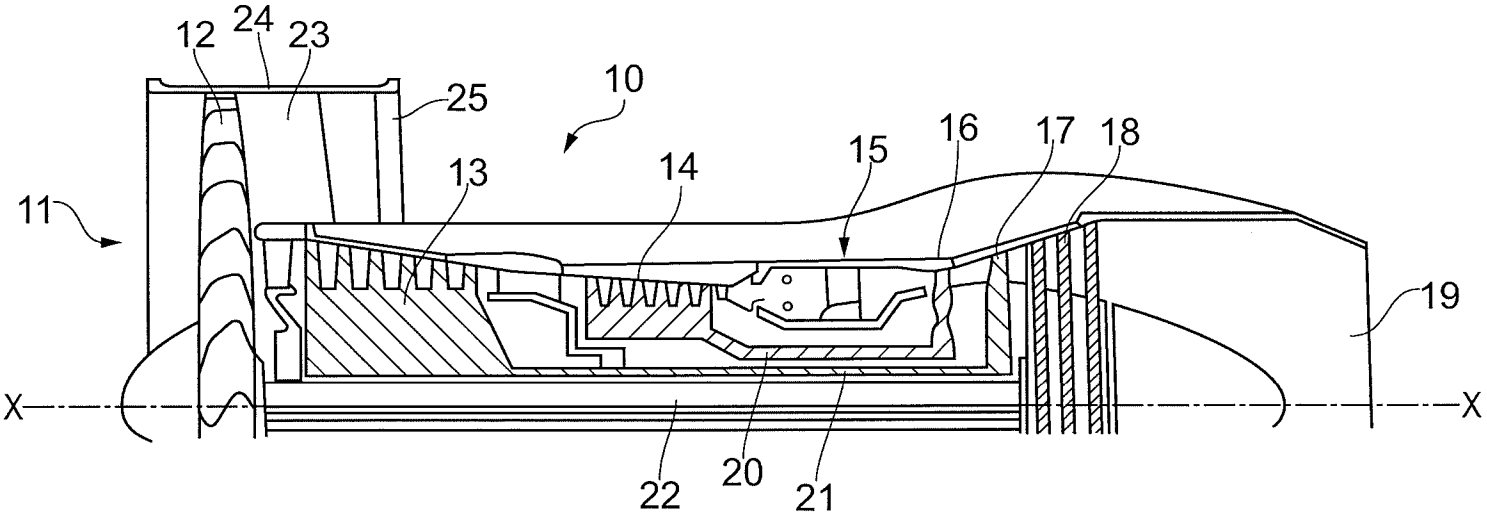
FIG. 1 is sectional side view of an upper half of a turbofan gas turbine engine having a bladed rotor arrangement according to the present disclosure.
Figure 2:
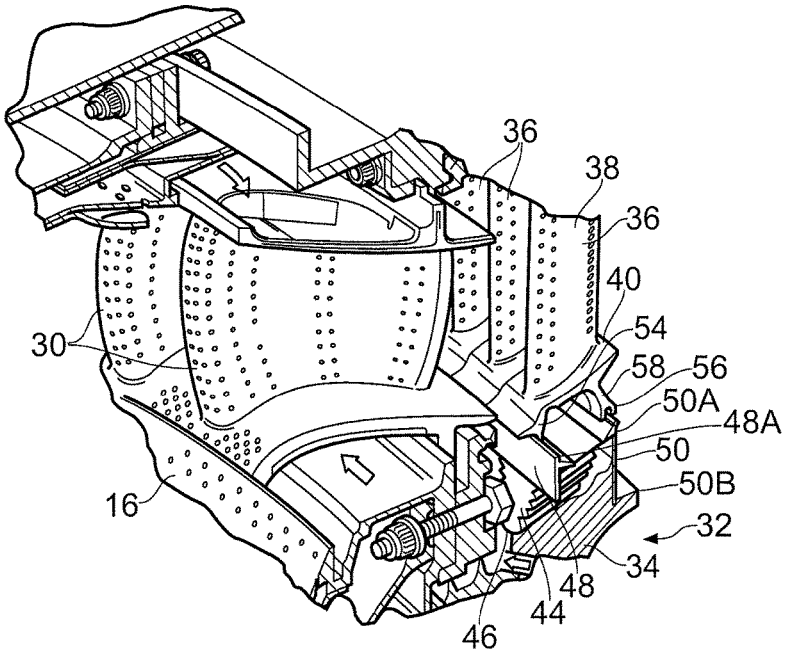
FIG. 2 is a perspective view of part of a turbine of the turbofan gas turbine engine showing the bladed rotor arrangement according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 20. The intermediate pressure turbine 17 is arranged to drive the intermediate pressure compressor 13 via a second shaft 21 and the low pressure turbine 18 is arranged to drive the fan 12 via a third shaft 22. In operation air flows into the intake 11 and is compressed by the fan 12. A first portion of the air flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leaving the low pressure turbine 18 flow through the exhaust 19 to provide propulsive thrust. A second portion of the air bypasses the main engine and flows through a bypass duct 23 defined by a fan casing 24. The second portion of air leaving the bypass duct 23 flows through a bypass, or fan, nozzle 25 to provide propulsive thrust.

A part of the high pressure turbine 16 of the turbofan gas turbine engine 10 is shown more clearly in FIGS. 2 to 8. The high pressure turbine 16 comprises a plurality of nozzle guide vanes 30 which guide hot gases from the combustion chamber 15 onto the turbine rotor blades 36 of a bladed turbine rotor arrangement 32. The bladed turbine rotor arrangement 32 comprises a turbine rotor 34, a plurality of turbine rotor blades 36 and a plurality of lock plates 48 and 50. The turbine rotor blades 36 are mounted on the periphery of the turbine rotor 34 and each turbine rotor blade 36 comprises an aerofoil 38, a platform 40, a shank 42 and a root 44. The turbine rotor 34 comprises a plurality of circumferentially spaced axially extending slots 46 and the root 44 of each turbine rotor blade 36 locates in a respective one of the axially extending slots 46 in the periphery of the turbine rotor 34. The turbine rotor 34 in this example comprises a turbine disc. The roots 44 of the turbine rotor blades 36 are generally fir tree shaped and the axially extending slots 46 are correspondingly shaped to receive the roots 44 of the turbine rotor blades 36. However, the roots 44 of the turbine rotor blades 36 may be dovetail shaped and the axially extending slots 46 are correspondingly shaped to receive the roots 44 of the turbine rotor blades 36.

A plurality of lock plates 48 are arranged at a first axial end, the upstream end, of the turbine rotor 34 and a plurality of lock plates 50 are arranged at a second axial end, the downstream end, of the turbine rotor 34. The lock plates 48 and 50 prevent the turbine rotor blades 36 moving axially upstream and downstream respectively relative to the turbine rotor 34. The lock plates 48 and 50 also acts as seals to prevent fluid flowing through the axially extending slots 46 in the turbine rotor 34 and axially between the shanks 42 of the turbine rotor blades 36 and radially between the platforms 40 of the turbine rotor blades 36 and the periphery of the turbine rotor 34. The radially outer ends 48A of the lock plates 48 at the first axial end of the turbine rotor 34 engage grooves 52 defined by radially inwardly extending flanges 54 on the first axial ends, upstream ends, of the platforms 40 of the turbine rotor blades 36 and the radially outer ends 50A of the lock plates 50 at the second axial end of the turbine rotor 34 engage grooves 56 defined by radially inwardly extending flanges 58 on the second axial ends, downstream ends, of the platforms 40 of the turbine rotor blades 36. The radially inner ends 48B and 50B of the lock plates 48 and 50 engage circumferentially extending grooves 60 and 62 respectively.

Figure 5:
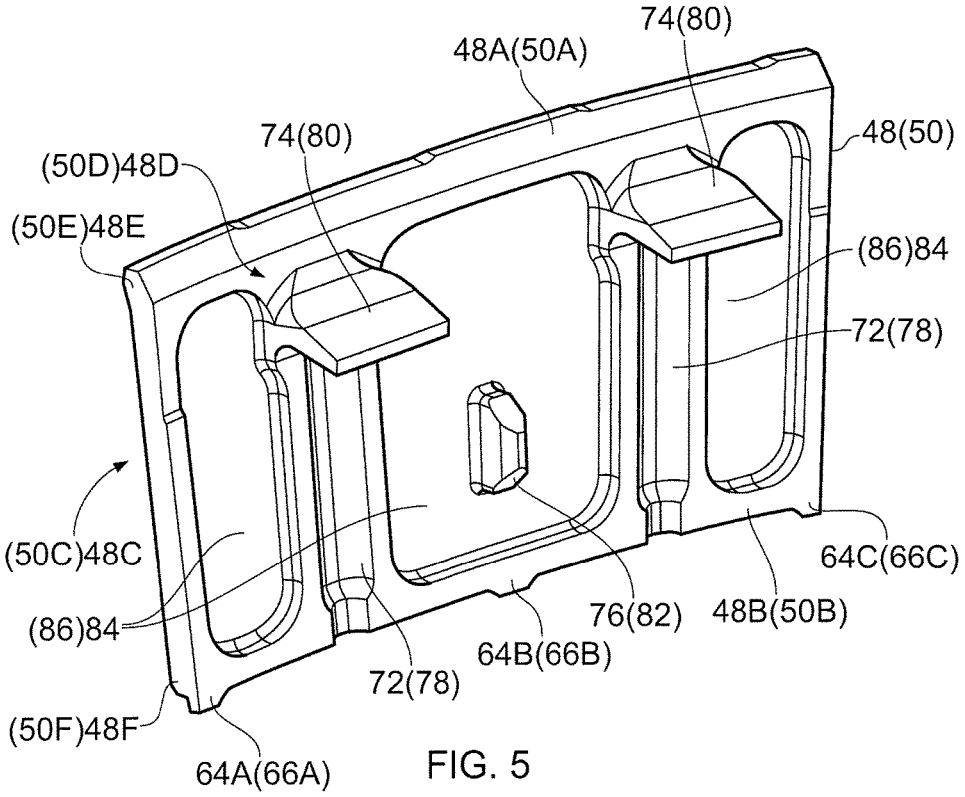
FIG. 5 is an enlarged perspective view of a lock plate of the bladed rotor arrangement according to the present disclosure.

The radially inner end 48B of at least one of the lock plate 48 has a first foot 64A at a first end, a first circumferential end, of the lock plate 48, a second foot 64B in a mid-region, mid-circumferential region, of the lock plate 48 and a third foot 64C at a second end, a second circumferential end, of the lock plate 48, as seen more clearly in FIG. 5. The first, second and third feet 64A, 64B and 64C of the at least one lock plate 48 are crushable and/or deformable. In particular the radially inner 48B end of each lock plate 48 has a first foot 64A at a first end, a first circumferential end, of the lock plate 48, a second foot 64B in a mid-region of the lock plate 48 and a third foot 64C at a second end, a second circumferential end, of the lock plate 48. The first foot 64A, the second foot 64B and the third foot 64C of each lock plate 48 are crushable and/or deformable. The first foot 64A, the second foot 64B or the third foot 64C is axially thinner than the remainder of the lock plate 48. In particular the first foot 64A, the second foot 64B and the third foot 64C of each lock plate 48 are axially thinner than the remainder of the lock plate 48. The first foot 64A, the second foot 64B and the third foot 64C extend radially inwardly from the radially inner end 48B of the lock plate 48. The radial height of the first, second or third foot 64A, 64B or 64C may be between 1 and 1.6 times the axial thickness of the first, second or third foot 64A, 64B or 64C. The radial height of the first, second and third foot 64A, 64B or 64C may be between 0.6 mm to 0.8 mm inclusive. The axial thickness of the first, second or third foot 64A, 64B or 64C may for example be 0.5 mm. The radially inner end of the first, second and third foot 64A, 64B and 64C are arranged as a radius of the turbine rotor 34.

Similarly radially inner end 50B of at least one of the lock plate 50 has a first foot 66A at a first end, a first circumferential end, of the lock plate 50, a second foot 66B in a mid-region, mid-circumferential region, of the lock plate 50 and a third foot 66C at a second end, a second circumferential end, of the lock plate 48, as seen in FIG. 5. The first, second and third feet 66A, 66B and 66C of the at least one lock plate 50 are crushable and/or deformable. In particular the radially inner 50B end of each lock plate 50 has a first foot 66A at a first end, a first circumferential end, of the lock plate 50, a second foot 66B in a mid-region of the lock plate 50 and a third foot 66C at a second end, a second circumferential end, of the lock plate 50. The first, second and third feet 66A, 66B and 66C of each lock plate 50 are crushable and/or deformable. The first foot 66A, the second foot 66B or the third foot 66C is axially thinner than the remainder of the lock plate 50. In particular the first foot 66A, the second foot 66B and the third foot 66C of each lock plate 50 are axially thinner than the remainder of the lock plate 50. The first foot 66A, the second foot 66B and the third foot 66C extend radially inwardly from the radially inner end 50B of the lock plate 50. The radial height of the first, second or third foot 66A, 66B or 66C may be between 1 and 1.6 times the axial thickness of the first, second or third foot 66A, 66B or 66C. The radial height of the first, second and third foot 66A, 66B or 66C may be between 0.5 mm to 1.0 mm inclusive or between 0.6 mm to 0.8 mm inclusive. The axial thickness of the first, second or third foot 66A, 66B or 66C may for example be 0.5 mm. The radially inner end of the first, second and third foot 66A, 66B and 66C are arranged as a radius of the turbine rotor 34. The radially inner end of the first, second and third foot 66A, 66B and 66C may have a circumferential dimension between 1.0 mm and 3.0 mm inclusive or between 2 and 6 times the axial thickness of the first, second or third foot 66A, 66B and 66C.

Figure 3:
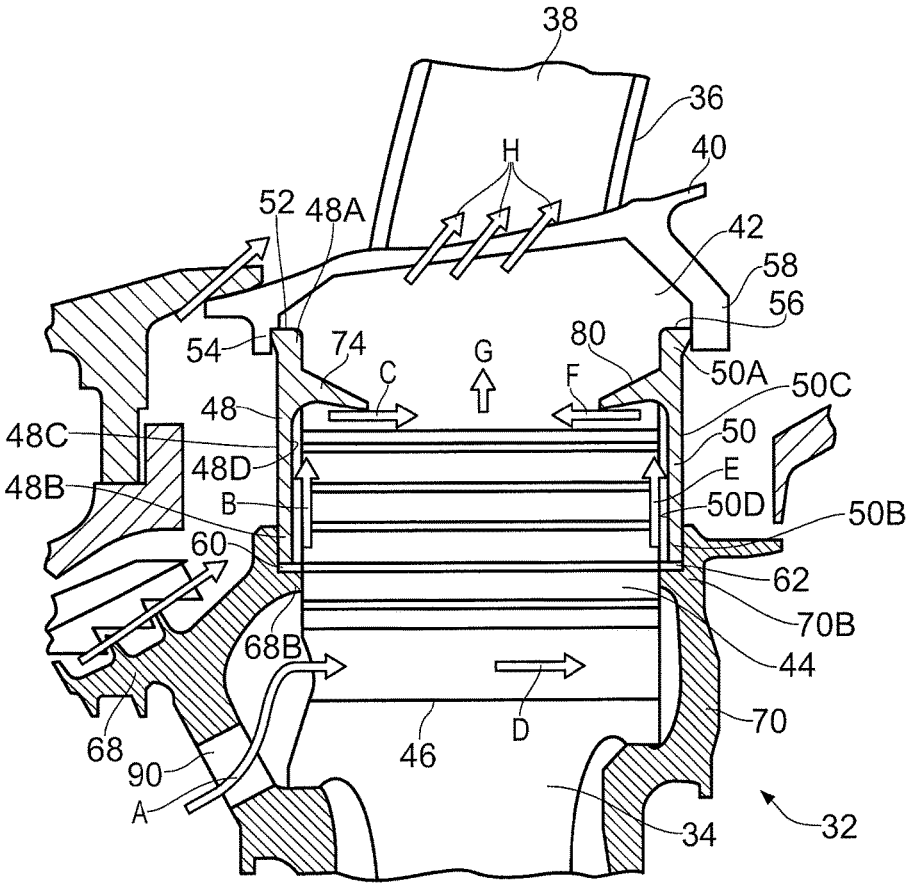
FIG. 3 is an enlarged cross-sectional view of the bladed rotor arrangement according to the present disclosure.
Figure 4:
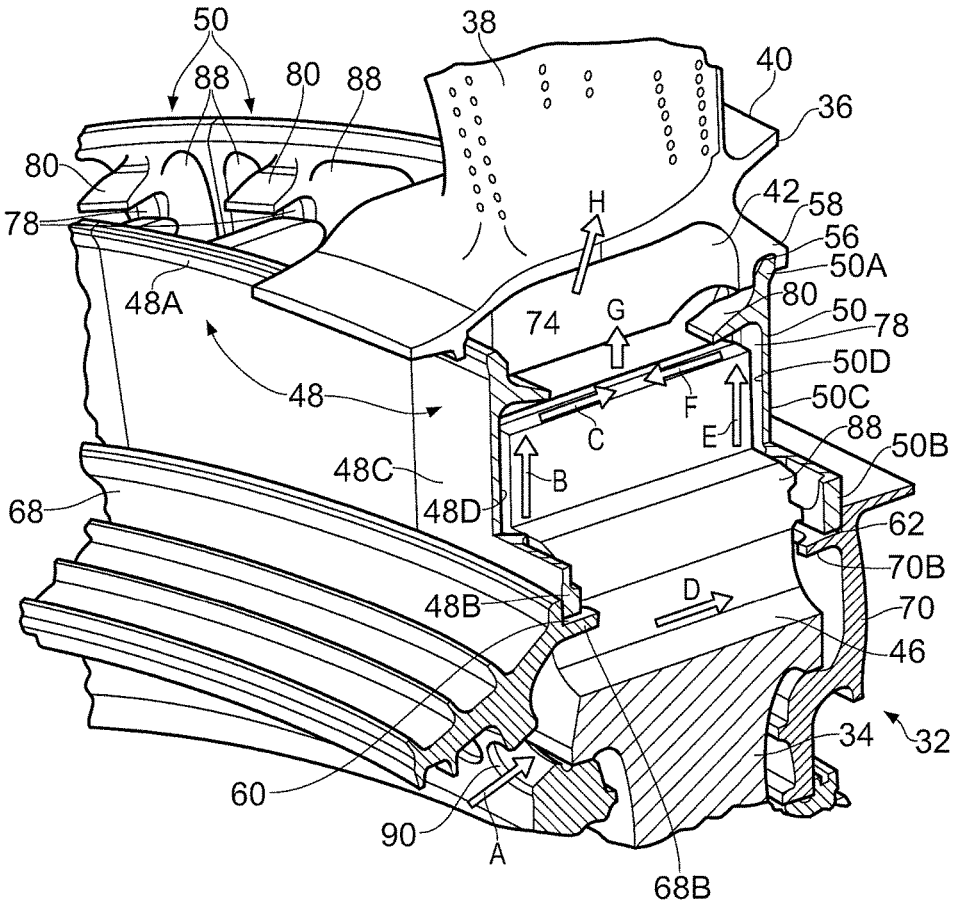
FIG. 4 is a perspective sectional side view of the bladed rotor arrangement according to the present disclosure.

The bladed turbine rotor arrangement 32 also comprises a plurality of seal plates, as seen in FIGS. 3 and 4. A single seal plate 68 or a plurality of seal plates 68 are arranged at the first axial end of the turbine rotor 34 and a single seal plate 70 or a plurality of seal plates 70 are arranged at the second axial end of the turbine rotor 32. If a single seal plate 68 is used then this is a ring and if a single seal plate 70 is used then this is a ring. The radially inner ends 48B of the lock plates 48 at the first axial end of the turbine rotor 34 engage, locate in, the circumferentially extending groove 60 at least partially defined by the seal plate, or seal plates, 68 at the first axial end of the turbine rotor 32 and the first axial end of the turbine rotor 34. The radially inner ends 50B of the lock plates 50 at the second axial end of the turbine rotor 32 engage, locate in, the circumferentially extending groove 62 at least partially defined by the seal plate, or seal plates, 70 at the second axial end of the turbine rotor 32 and the second axial end of the turbine rotor 34. The seal plate 68 is arranged to press the lock plates 48 towards the first axial end of the turbine rotor 34 and similarly the seal plate 70 is arranged to press the lock plates 50 towards the second axial end of the turbine rotor 34.

The seal plate, or seal plates, 68 have an outer radius which is less than the outer radius of the periphery of the turbine rotor 34, the seal plate, or seal plates, 68 have an outer radius which is greater than the radius of the radially inner ends of the slots 46 in the periphery of the turbine rotor 34 and the seal plate, or seal plates, 68 have an outer radius which is greater than the radius of the radially inner ends of the roots 44 of the turbine rotor blades 36. Similarly the seal plate, or seal plates, 70 have an outer radius which is less than the outer radius of the periphery of the turbine rotor 34, the seal plate, or seal plates, 70 have an outer radius which is greater than the radius of the radially inner ends of the slots 46 in the periphery of the turbine rotor 34 and the seal plate, or seal plates, 70 have an outer radius which is greater than the radius of the radially inner ends of the roots 44 of the turbine rotor blades 36.

The seal plate 68 and the lock plates 48 are configured and dimensioned so that under adverse tolerances the inner radii of the lock plates 48 are always at a lower radius than the outer radius of the seal plate 68 and provide sufficient radial overlap. The seal plate 70 and the lock plates 50 are configured and dimensioned so that under adverse tolerances the inner radii of the lock plates 50 are always at a lower radius than the outer radius of the seal plate 70 and provide sufficient radial overlap.

Figure 6:
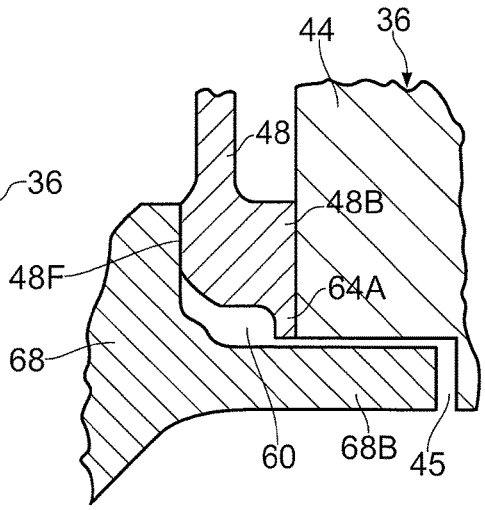
FIG. 6 is a further enlarged cross-sectional view of the radially inner end of a lock plate, the radially outer end of a seal plate and the base of a rotor blade shown in FIGS. 3 and 4.
Figure 7:
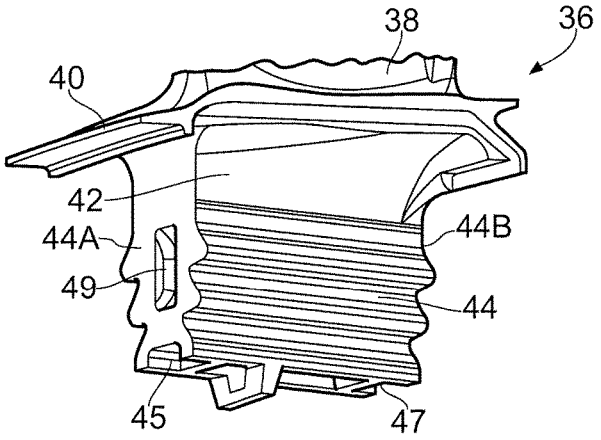
FIG. 7 is a perspective view of a rotor blade of the bladed rotor arrangement according to the present disclosure.

The seal plate, or seal plates, 68 have anti-rotation features 68B which extend in an axially downstream direction therefrom, a single anti-rotation feature 68B is seen more clearly in FIG. 6. Each anti-rotation feature 68B comprises a projection, which locates in a slot 45 at the first axial end, the upstream end, 44A of the radially inner end of the root 44 of a corresponding one of the turbine rotor blades 36, as seen in FIG. 7.

Figure 8:
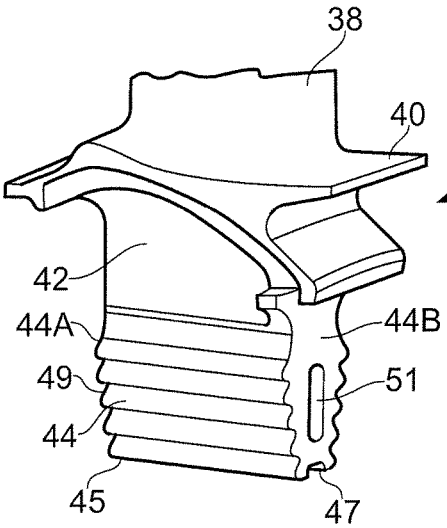
FIG. 8 is a further perspective view of a rotor blade of the bladed rotor arrangement according to the present disclosure.

Similarly the seal plate, or seal plates, 70 have anti-rotation features 70B which extend in an axially upstream direction therefrom. Each anti-rotation feature 70B comprises a projection, which locates in a slot 47 at the second end, the downstream end, 44B of the radially inner end of the root 44 of a corresponding one of the turbine rotor blades 36, as seen in FIG. 8. The slots 45 and 47 are actually formed in the bottom surface of the root 44 in this example.

In this example a single seal plate 68 is provided at the first axial end of the turbine rotor 34, the single seal plate 68 has an axially extending flange to define the circumferentially extending groove 60 and in this example a single seal plate 70 is provided at the second axial end of the turbine rotor 34, the single seal plate 70 is provided with an axially extending flange to define the circumferentially extending groove 62. The single seal plate 68 provided at the first axial end of the turbine rotor 34 has a plurality of anti-rotation features 68B and each anti-rotation feature comprises a projection extending axially from the single seal plate 68 and each anti-rotation feature 68 is arranged to locate in a slot 45 in the first axial end of the root 44 of a corresponding turbine rotor blade 36. The single seal plate 70 provided at the second axial end of the turbine rotor 34 has a plurality of anti-rotation features 70B and each anti-rotation feature 70B comprises a projection extending axially from the single seal plate 70 and each anti-rotation feature 70B is arranged to locate in a slot 47 in the second axial end of the root 44 of a corresponding turbine rotor blade 36. The anti-rotation features 68 extend from the axially extending flange on the single seal plate 68 at the first axial end of the turbine rotor 34 and the anti-rotation features 70B extend from the axially extending flange on the single seal plate 70 at the second axial end of the turbine rotor 34. The seal plate 68 also carries a plurality of axially spaced circumferentially extending lands which define a labyrinth seal with an adjacent static structure to control a flow of coolant over the first face 48C of the lock plates 48.

It may be possible to provide a plurality of seal plates 68 at the first axial end of the turbine rotor 34, each of the seal plates 68 has an axially extending flange to define the circumferentially extending groove 60 and/or it may be possible to provide a plurality of seal plates 70 at the second axial end of the turbine rotor 34, each of the seal plates 70 has an axially extending flange to define the circumferentially extending groove 62. If a plurality of seal plates 68 are provided at the first axial end of the turbine rotor 34, each seal plate 68 has an anti-rotation feature 68B and each anti-rotation feature 68B comprises a projection extending axially from the seal plate 68 and the anti-rotation feature 68B of each seal plate 68 is arranged to locate in a slot 45 in the first axial end of the root 44 of a corresponding turbine rotor blade 36. If a plurality of seal plates 70 are provided at the second end of the turbine rotor 34, each seal plate 70 has an anti-rotation feature 70B and each anti-rotation feature 70B comprises a projection extending axially from the seal plate 70 and the anti-rotation feature 70B of each seal plate 70 is arranged to locate in a slot 47 in the second axial end of the root 44 of a corresponding turbine rotor blade 36. Each of the seal plates 68 at the first axial end of the turbine rotor 34 has an anti-rotation feature 68B extending axially from its axially extending flange and each of the seal plates 70 at the second axial end of the turbine rotor 34 has an anti-rotation feature 70B extending axially from its axially extending flange.

The middle foot 64B of each lock plate 48 is arranged to rest on a corresponding one of the anti-rotation features 68B on the seal plate, or seal plate 68 and the middle foot 66B of each lock plate 50 is arranged to rest on a corresponding one of the anti-rotation features 70B on the seal plate, or seal plate 70. The first foot 64A of each lock plate 48 is arranged to rest on a half of a corresponding one of the anti-rotation features 68B on the seal plate, or seal plate 68, the third foot 64C of each lock plate 48 is also arranged to rest on a half of a corresponding one of the anti-rotation features 68B on the seal plate, or seal plate 68 and thus the first foot 64A of one lock plate 48 and the third foot 64C of a circumferentially adjacent lock plate 48 rest on and share the same anti-rotation feature 68B. The first foot 66A of each lock plate 50 is arranged to rest on a half of a corresponding one of the anti-rotation features 70B on the seal plate, or seal plate 70, the third foot 66C of each lock plate 50 is also arranged to rest on a half of a corresponding one of the anti-rotation features 70 on the seal plate, or seal plate 70 and thus the first foot 66A of one lock plate 50 and the third foot 66C of a circumferentially adjacent lock plate 50 rest on and share the same anti-rotation feature 70B.

The lock plates 48 and 50 are arranged so that the dimensions of the feet in the axial direction and in the circumferential direction are as small as possible, whilst ensuring that the middle foot 64B and 66B of the lock plates 48 and 50 respectively does not dis-engage from the anti-rotation features 68B and 70B on the seal plate, or seal plates, 68 and 70 respectively due to adverse manufacturing tolerances and circumferential position. The minimisation of the axial and circumferential dimensions of the feet ensures that the feet of the lock plates 48 and/or 50 should crush and/or deform to mitigate any loads put onto the grooves in the platforms of the turbine rotor blades 36 and/or anti-rotation features 68B and/or 70B on the seal plates 68 and/or 70 respectively.

The radially outer end 48A of each lock plate 48 has a lip 48E and the radially inner end 48B of each lock plate 48 has a lip 48F, as seen in FIG. 5. Each lock plate 48 has a first face 48C facing away from the turbine rotor 32 and a second face 48D facing the turbine rotor 32. The first face 48C of each lock plate 48 is generally flat between the lips at the radially inner and radially outer ends 48A and 48B of the lock plate 48. The second face 48B of each lock plate 48 has at least one channel 72 and at least one deflector 74. The at least one channel 72 extends radially from the radially inner end 48B of the lock plate 48 towards the radially outer end 48A of the lock plate 48. The at least one deflector 74 is arranged at the radially outer end of the at least one channel 72 and the at least one deflector 74 extending axially from the second face 48D of the lock plate 48. Preferably the second face 48D of each lock plate 48 has a plurality of channels 72 and a plurality of deflectors 74. Each channel 72 extends radially from the radially inner end 48B of the lock plate 48 towards the radially outer end 48A of the lock plate 48, each deflector 74 is arranged at the radially outer end of a corresponding one of the channels 72 and each deflector extends axially from the second face 48D of the lock plate 48.

Similarly, the radially outer end 50A of each lock plate 50 has a lip 50E and the radially inner end 50B of each lock plate 50 has a lip 50F, as seen in FIG. 5. Each lock plate 50 has a first face 50C facing away from the turbine rotor 32 and a second face 50D facing the turbine rotor 32. The first face 50C of each lock plate 50 is generally flat between the lips at the radially inner and radially outer ends 50A and 50B of the lock plate 50. The second face 50D of each lock plate 50 has at least one channel 78 and at least one deflector 80. The at least one channel 78 extends radially from the radially inner end 50B of the lock plate 50B towards the radially outer end 50A of the lock plate 50. The at least one deflector 80 is arranged at the radially outer end of the at least one channel 78 and the at least one deflector 80 extends axially from the second face 50D of the lock plate 50. Preferably the second face 50D of each lock plate 50 has a plurality of channels 78 and a plurality of deflectors 80. Each channel 78 extends radially from the radially inner end of the lock plate 50B towards the radially outer end 50A of the lock plate 50, each deflector 80 is arranged at the radially outer end of a corresponding one of the channels 78 and each deflector 80 extends axially from the second face 50D of the lock plate 50.

In operation coolant, air, A is supplied through apertures 90 in the seal plate, or seal plates, 68 and the coolant flows radially outwardly over the upstream surface of the turbine rotor 34. The channels 72 and 78 on the lock plates 48 and 50 respectively enable flows of coolant, air, B and E respectively radially outwardly over the surfaces at the upstream and downstream ends of the turbine rotor 32 between the axially extending slots 46, e.g. over the surfaces of the turbine rotor posts 88. The coolant flow E initially flows axially D along the slots 46 and underneath the roots 44 of the turbine rotor blades 36. The coolant, air, is deflected by the deflectors 74 and 80 on the lock plates 48 and 50 respectively so that the coolant, air, flows C and F respectively axially over the radially outer peripheral surface of the turbine rotor 32 axially between the axially extending slots 46. The portions of the turbine rotor 32 between the axially extending slots 46 are called turbine rotor posts 88. The coolant, air, then flows G into the spaces defined the between the platforms 40 and shanks 42 of adjacent turbine rotor blades 36, the turbine rotor posts 88 and the lock plates 48 and 50. The coolant, air, then flows H out of these spaces through apertures in the platforms 40 of the turbine rotor blades 36. Some of the coolant flow D through the slots 46 flows into the turbine rotor blades 36 to cool the rotor blades 36.

The seal plates 68 and 70 and the lock plates 48 and 50 control the coolant flow over the upstream and downstream surfaces of the turbine rotor 34, the surfaces of the turbine rotor posts 88 and the coolant flow into the turbine rotor blades 36.

The second face 48D of each lock plate 48 has at least one pocket 84 and preferably the second face 48D of each lock plate 48 has a plurality of pockets 84. Similarly, the second face 50D of each lock plate 50 has at least one pocket 86 and preferably the second face 50D of each lock plate 50 has a plurality of pockets 86.

Figure 10:
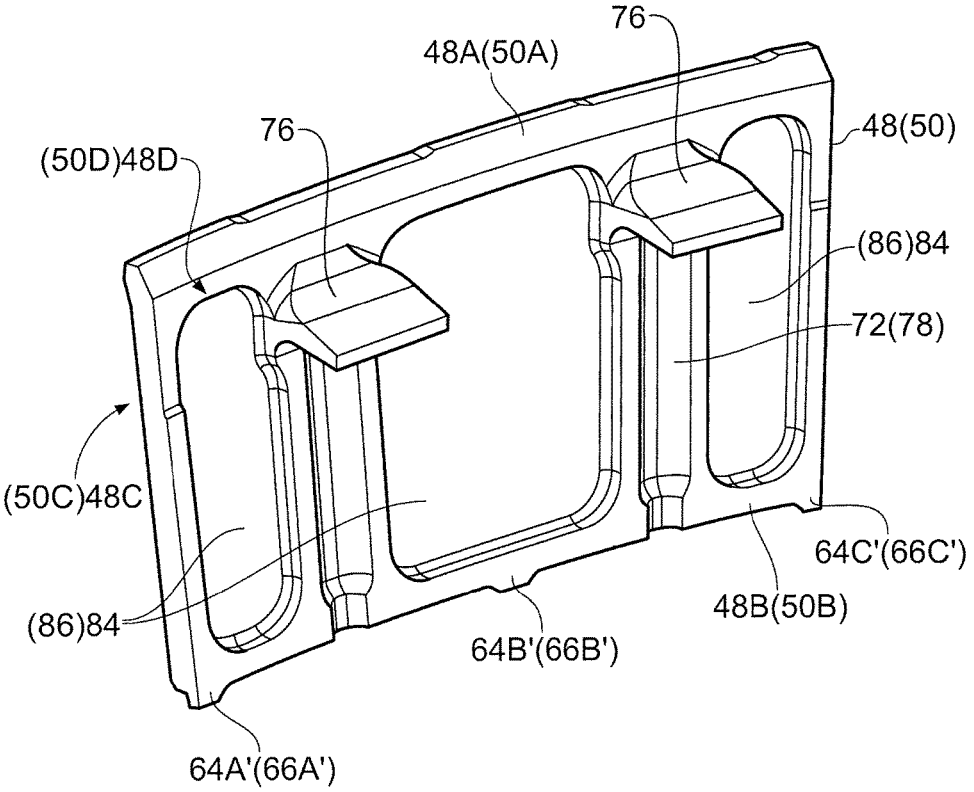
FIG. 10 is another enlarged perspective view of an alternative lock plate of the bladed rotor arrangement according to the present disclosure.

The second face 48D of each lock plate 48 has an anti-rotation feature 76. The anti-rotation feature 76 is a projection extending axially from the second face 48D of the lock plate 48 and is arranged to locate in a slot 49 at the first axial end, the upstream end, 44A of the root 44 of a turbine rotor blade 36. Alternatively, as shown in FIG. 10, the anti-rotation feature 30 may comprise a pair of circumferentially spaced projections 76 extending axially from the second face of the lock plate, the projections being arranged to locate against the shanks of circumferentially spaced apart turbine rotor blades.

Similarly, the second face 50D of each lock plate 50 has an anti-rotation feature 82. The anti-rotation feature 82 is a projection extending axially from the second face 50D of the lock plate 50 and is arranged to locate in a slot 51 at the second axial end, the downstream end, 44B of the root 44 of a turbine rotor blade 36. Alternatively, the anti-rotation feature may comprise a pair of circumferentially spaced projections extending axially from the second face of the lock plate, the projections being arranged to locate against the shanks of circumferentially spaced apart turbine rotor blades.

It is to be noted that the feet 64A, 64*b* and 64C are located axially at the downstream end of the lock plates 48 and are continuations from the second face 48D of the lock plates 48. Similarly, it is to be noted that the feet 66A, 66B and 66C are located axially at the upstream end of the lock plates 50 and are continuations from the second face 50D of the lock plates 50.

The lips 48E at the radially outer ends 48A of the lock plates 48 engage the grooves 52 and the lips 48F at the radially inner ends 48B of the lock plates 48 engage the groove 60. Similarly the lips 50E at the radially outer ends 50A of the lock plates 50 engage the grooves 56 and the lips 50F at the radially inner ends 50B of the lock plates 50 engage the groove 62. As mentioned previously each of the feet 64A, 64B and 64C at the radially inner ends 48A of the lock plates 48 are located axially at the downstream ends of the lock plates 48 and are a continuation of the second face 48D of the lock plates 48 and so each of the feet 64A, 64B and 64C is axially spaced from the radially outwardly extending portions of the seal plate, or seal plates, 68 defining the groove 60. Similarly each of the feet 66A, 66B and 66C at the radially inner ends 50A of the lock plates 50 are located axially at the upstream ends of the lock plates 50 and are a continuation of the second face 50D of the lock plates 50 and so each of the feet 66A, 66B and 66C is axially spaced from the radially outwardly extending portions of the seal plate, or seal plates, 68 defining the groove 62.

The seal plate, or seal plates, 68 are arranged such that their radially outer end, or radially outer ends, have a smooth continuous arcuate shape. In particular if there is a single annular seal plate 68 the radially outer end of the annular seal plate 68 has the same radius throughout the full circumference of the annular seal plate 68. If there is a plurality of seal plates 68 the radially outer ends of the seal plates 68 are arranged to lie on the same radius throughout the full circumference of the seal plates 68. Similarly, the seal plate, or seal plates, 70 are arranged such that their radially outer end, or radially outer ends, have a smooth continuous arcuate shape. In particular if there is a single annular seal plate 70 the radially outer end of the annular seal plate 70 has the same radius throughout the full circumference of the annular seal plate 70. If there is a plurality of seal plates 70 the radially outer ends of the seal plates 70 are arranged to lie on the same radius throughout the full circumference of the seal plates 70.

Figure 9:
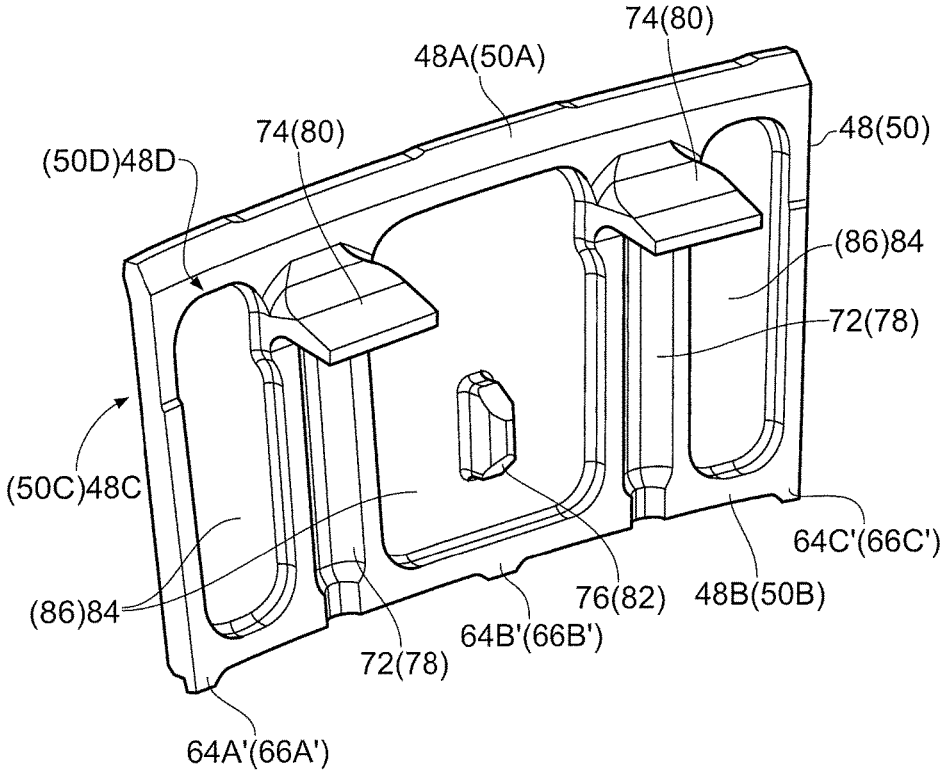
FIG. 9 is an enlarged perspective view of an alternative lock plate of the bladed rotor arrangement according to the present disclosure.

FIG. 9 shows an alternative lock plate which is substantially the same as that shown in FIG. 5, but differs in that the first, second and third foot 64A' 64B' and 64C' of lock plate 48 and/or the first, second and third foot 66A', 66B' and 66C' of lock plate 50 are smoothly curved from the radially inner end of the lock plate 48 and 50 respectively. However, these lock plates work in substantially the same manner as those shown in FIG. 5.

The crushable feet make the lock plates radially tall enough to stay engaged axially but at the same time mitigate the risk of significant radial chocking if there is any significant radial contact loading under adverse tolerances and/or transient thermal effects since the feet will crush and then become the optimum radial height. The feet are sized such that the load to crush the feet imparts a negligible reaction load to the lock plates or the turbine rotor blades.

Although the present disclosure has been described with reference to the radially inner ends of the lock plates 48 and 50 engaging circumferentially extending grooves partially defined by the seal plates 68 and 70 it may be equally possible for the lock plates 48 to engage a circumferentially extending groove partially defined the turbine rotor 32 and/or the lock plates 50 to engage a circumferentially extending groove partially defined by the turbine rotor 32. The radially inner ends of the lock plates 48 may engage a circumferentially extending groove formed by an annular radially extending member spaced axially from the upstream end of the turbine rotor 32 and the radially outer end of the annular radially extending member has the same radius throughout the full circumference of the annular radially extending member. Similarly, the radially inner ends of the lock plates 50 may engage a circumferentially extending groove formed by an annular radially extending member spaced axially from the downstream end of the turbine rotor 32 and the radially outer end of the annular radially extending member has the same radius throughout the full circumference of the annular radially extending member.

Although the present invention has been described with reference to a lock plate in which the radially inner end of the lock plate has a first foot positioned at a first end of the lock plate, a second foot positioned in a middle region of the lock plate and a third foot positioned at a second end of the lock plate it may be equally applicable to a lock plate in which the radially inner end of the lock plate has a first foot positioned at a first end of the lock plate and a second foot positioned at a second end of the lock plate or more generally to a lock plate in which the radially inner end of the lock plate has a first foot and a second foot spaced circumferentially from the first foot. In the case of a lock plate with two feet, half of each foot may be positioned on a corresponding one of the anti-rotation features on the seal plate.

The advantage of a bladed rotor arrangement according to the present disclosure is that the risk that the lock plates become disengaged or the risk that the lock plates chock against the rotor, or seal plates, and additional radial loads being reacted by the rotor blades through the roots of the rotor blades into the rotor are reduced.

Although the present disclosure has been described with reference to a bladed turbine rotor arrangement of a high pressure turbine it is equally applicable to a bladed turbine rotor arrangement of an intermediate pressure turbine or a low pressure turbine.

Although the present disclosure has been described with reference to a bladed turbine rotor arrangement it is equally applicable to a bladed compressor rotor arrangement, whether a high pressure compressor, an intermediate pressure compressor or a low pressure compressor or a fan. A bladed compressor rotor may comprise a compressor disc or a compressor drum. The bladed compressor rotor arrangement may comprise a compressor disc and a plurality of compressor rotor blades or a compressor drum and a plurality of compressor rotor blades.

Although the present disclosure has been described with reference to bladed rotor arrangement for a gas turbine engine, it is equally applicable to a bladed rotor arrangement for other types of turbomachine, e.g. a steam turbine etc.

The invention claimed is:

1. A bladed rotor arrangement comprising a rotor, a plurality of rotor blades and a plurality of lock plates, the rotor blades being mounted on a periphery of the rotor, each rotor blade comprising an aerofoil, a platform, a shank and a root, the rotor comprising a plurality of circumferentially spaced axially extending slots, the root of each rotor blade locating in a respective one of the axially extending slots in the periphery of the rotor, the plurality of lock plates being arranged at a first axial end of the rotor, radially outer ends of the lock plates at the first axial end of the rotor engaging grooves defined by radially inwardly extending flanges on the platforms of the rotor blades, radially inner ends of the lock plates at the first axial end of the rotor engaging a first circumferentially extending groove, the first circumferentially extending groove being defined by the rotor and a first radially extending member spaced axially from the first axial end of the rotor, the radially outer end of the at least one first radially extending member having the same radius throughout the full circumference of the first radially extending member, the radially inner end of at least one lock plate at the first axial end of the rotor having a first foot and a second foot spaced circumferentially from the first foot, and the first and second feet of the at least one lock plate being deformable, wherein the first and second feet are axially thinner than the remainder of the at least one lock plate.

2. The bladed rotor arrangement as claimed in claim 1 wherein another plurality of lock plates is arranged at a second axial end of the rotor, radially outer ends of the lock plates at the second axial end of the rotor engaging grooves defined by radially inwardly extending flanges on the platforms of the rotor blades, radially inner ends of the lock plates at the second axial end of the rotor engaging a second circumferentially extending groove, the second circumferentially extending groove being defined by the rotor and a second radially extending member spaced axially from the second axial end of the rotor, the radially outer end of the second radially extending member having the same radius throughout the full circumference of the second radially extending member, the radially inner end of at least one lock plate at the second axial end of the rotor having a first foot and a second foot spaced circumferentially from the first foot, and the first and second feet of the at least one lock plate at the second axial end of the rotor being deformable.

3. The bladed rotor arrangement as claimed in claim 2 wherein, of the radially inner end of the at least one lock plate at the first axial end of the rotor, the first foot is located at a first end of the at least one lock plate at the first axial end of the rotor, the second foot is located at a second end of the at least one lock plate at the first axial end of the rotor, and the radially inner end of the at least one lock plate at the first axial end of the rotor has a third foot in a mid-region of the lock plate at the first axial end of the rotor, the third foot of the at least one lock plate at the first axial end of the rotor being deformable, and wherein, of the radially inner end of the at least one lock plate at the second axial end of the rotor, the first foot is located at a first end of the at least one lock plate at the second axial end of the rotor, the second foot is located at a second end of the at least one lock plate at the second axial end of the rotor, and the radially inner end of the at least one lock plate at the second axial end of the rotor has a third foot in a mid-region of the lock plate at the second axial end of the rotor, the third foot of the at least one lock plate at the second axial end of the rotor being deformable.

4. The bladed rotor arrangement as claimed in claim 1 wherein the first foot is located at a first end of the at least one lock plate, and the second foot is located at a second end of at least one the lock plate.

5. The bladed rotor arrangement as claimed in claim 1 wherein the first foot is located at a first end of the at least one lock plate, the second foot is located in a mid-region of the at least one lock plate, and the radially inner end of the at least one lock plate has a third foot at a second end of the at least one lock plate, the third foot being deformable.

6. The bladed rotor arrangement as claimed in claim 5 wherein the third foot is axially thinner than the remainder of the at least one lock plate.

7. The bladed rotor arrangement as claimed in claim 5 wherein a radial height of the first, second or third foot is between 1 and 1.6 times an axial thickness of the first, second or third foot.

8. The bladed rotor arrangement as claimed in claim 5 wherein the radially inner end of the first, second and third foot are aligned with a radius of the rotor.

9. The bladed rotor arrangement as claimed in claim 5 wherein the first, second and third foot of the at least one lock plate are smoothly curved from the radially inner end of the at least one lock plate.

10. The bladed rotor arrangement as claimed in claim 1 wherein each lock plate has a first face facing away from the rotor and a second face facing the rotor, the second face of each lock plate has at least one channel and at least one deflector, the at least one channel extending radially from the radially inner end of the lock plate towards the radially outer end of the lock plate, the at least one deflector being arranged at a radially outer end of the at least one channel, the at least one deflector extending axially from the second face of the lock plate.

11. The bladed rotor arrangement as claimed in claim 10 wherein the second face of each lock plate has a plurality of channels and a plurality of deflectors, each channel extending radially from the radially inner end of the lock plate towards the radially outer end of the lock plate, each deflector being arranged at the radially outer end of a corresponding one of the channels, each deflector extending axially from the second face of the lock plate.

12. The bladed rotor arrangement as claimed in claim 1 wherein each lock plate has a first face facing away from the rotor and a second face facing the rotor, the second face of each lock plate has an anti-rotation feature, the anti-rotation feature comprises a projection extending axially from the second face of the lock plate and is arranged to locate in a slot in the root of a rotor blade.

13. The bladed rotor arrangement as claimed in claim 1 wherein each lock plate has a first face facing away from the rotor and a second face facing the rotor, the second face of each lock plate has an anti-rotation feature, the anti-rotation feature comprises a pair of circumferentially spaced projections extending axially from the second face of the lock plate, the projections being arranged to locate against the shanks of circumferentially spaced apart rotor blades.

14. The bladed rotor arrangement as claimed in claim 1, further comprising a turbine disc and a plurality of turbine rotor blades.

15. The bladed rotor arrangement as claimed in claim 1 wherein the bladed rotor arrangement is a gas turbine engine bladed rotor arrangement.

16. The bladed rotor arrangement as claimed in claim 1, wherein, when the first axial end of the rotor is an upstream end of the rotor, the first foot axially abuts an upstream outer surface of the rotor, and when the first axial end of the rotor is a downstream end of the rotor, the first foot axially abuts a downstream outer surface of the rotor.

17. A bladed rotor arrangement comprising a rotor, a plurality of rotor blades and a plurality of lock plates, the rotor blades being mounted on a periphery of the rotor, each rotor blade comprising an aerofoil, a platform, a shank and a root, the rotor comprising a plurality of circumferentially spaced axially extending slots, the root of each rotor blade locating in a respective one of the axially extending slots in the periphery of the rotor, the plurality of lock plates being arranged at a first axial end of the rotor, radially outer ends of the lock plates at the first axial end of the rotor engaging grooves defined by radially inwardly extending flanges on the platforms of the rotor blades, radially inner ends of the lock plates at the first axial end of the rotor engaging a first circumferentially extending groove, the first circumferentially extending groove being defined by the rotor and a first seal plate spaced axially from the first axial end of the rotor, the radially outer end of the first seal plate having the same radius throughout the full circumference of the first seal plate, the radially inner end of at least one lock plate at the first axial end of the rotor having a first foot and a second foot spaced circumferentially from the first foot, and the first and second feet of the at least one lock plate being deformable, wherein the first and second feet are axially thinner than the remainder of the at least one lock plate, wherein another plurality of lock plates is arranged at a second axial end of the rotor, radially outer ends of the lock plates at the second axial end of the rotor engaging grooves defined by radially inwardly extending flanges on the platforms of the rotor blades, radially inner ends of the lock plates at the second axial end of the rotor engaging a second circumferentially extending groove, the second circumferentially extending groove being defined by the rotor and a second seal plate spaced axially from the second axial end of the rotor, the radially outer end of the second seal plate having the same radius throughout the full circumference of the second seal plate, the radially inner end of at least one lock plate at the second axial end of the rotor having a first foot and a second foot spaced circumferentially from the first foot, and the first and second feet of the at least one lock plate at the second axial end of the rotor being deformable, the bladed rotor arrangement further comprising a plurality of seal plates, at least one seal plate being arranged at the first axial end of the rotor and at least one seal plate being arranged at the second axial end of the rotor, the first seal plate being one of the at least one seal plate at the first axial end of the rotor, the second seal plate being one of the at least one seal plate at the second axial end of the rotor.

18. The bladed rotor arrangement as claimed in claim 17, the at least one seal plate at the first axial end of the rotor having at least one anti-rotation feature, the at least one anti-rotation feature extending axially from the at least one seal plate, each anti-rotation feature being located in a slot in an axial end of the root of a corresponding one of the rotor blades.

19. The bladed rotor arrangement as claimed in claim 18, the at least one anti-rotation feature being located in a slot in the axial end of a radially inner end of the root of the corresponding one of the rotor blades.

20. The bladed rotor arrangement as claimed in claim 18, the at least one seal plate at the first axial end of the rotor having a plurality of anti-rotation features.

21. The bladed rotor arrangement as claimed in claim 20, the feet of the at least one lock plate at the first axial end of the rotor resting on the anti-rotation features of the at least one seal plate at the first axial end of the rotor.

22. The bladed rotor arrangement as claimed in claim 21, wherein, of the at least one lock plate at the first axial end of the rotor, the second foot rests on a corresponding one of the anti-rotation features, the first foot rests on a half of a corresponding one of the anti-rotation features and a third foot of the at least one lock plate at the first axial end of the rotor rests on a half of a corresponding one of the anti-rotation features.

23. A bladed rotor arrangement comprising a rotor, a plurality of rotor blades and a plurality of lock plates, the rotor blades being mounted on a periphery of the rotor, each rotor blade comprising an aerofoil, a platform, a shank and a root, the rotor comprising a plurality of circumferentially spaced axially extending slots, the root of each rotor blade locating in a respective one of the axially extending slots in the periphery of the rotor, the plurality of lock plates being arranged at a first axial end of the rotor, radially outer ends of the lock plates at the first axial end of the rotor engaging grooves defined by radially inwardly extending flanges on the platforms of the rotor blades, radially inner ends of the lock plates at the first axial end of the rotor engaging a circumferentially extending groove, the circumferentially extending groove being defined by the rotor and at least one radially extending member spaced axially from the first axial end of the rotor, the radially outer end of the at least one radially extending member having the same radius throughout the full circumference of the at least one radially extending member, the radially inner end of at least one lock plate at the first axial end of the rotor having a first foot and a second foot spaced circumferentially from the first foot, and the first and second feet of the at least one lock plate being deformable, wherein, when the first axial end of the rotor is an upstream end of the rotor, the first foot axially abuts an upstream outer surface of the rotor, and when the first axial end of the rotor is a downstream end of the rotor, the first foot axially abuts a downstream outer surface of the rotor, the first foot protruding radially inwardly from portions of the lock plate immediately neighboring the first foot, and the second foot protruding radially inwardly from portions of the lock plate immediately neighboring the second foot.

* * * * *